United States Patent [19]

Lu

[11] 4,306,950

[45] Dec. 22, 1981

[54] PROCESS FOR FORMING SULFURIC ACID

[75] Inventor: Wen-Tong P. Lu, Upper St. Clair, Pa.

[73] Assignee: Westinghouse Electric Corp., Pittsburgh, Pa.

[21] Appl. No.: 84,494

[22] Filed: Oct. 15, 1979

[51] Int. Cl.[3] ..... C25B 1/22; C25B 11/08; C25B 11/10

[52] U.S. Cl. ..... 204/104; 204/290 R; 204/290 F; 204/291; 204/292; 204/293; 204/294

[58] Field of Search ..... 204/291, 292, 293, 104, 204/129, 290 F, 290 R, 294, 290 H

[56] References Cited

U.S. PATENT DOCUMENTS

| | | | |
|---|---|---|---|
| 3,103,474 | 9/1963 | Juda | 204/104 |
| 3,524,801 | 8/1970 | Parsi | 204/104 |
| 3,864,163 | 2/1975 | Beer | 204/290 F |
| 3,878,083 | 4/1975 | De Nora et al. | 204/290 F |
| 3,888,750 | 6/1975 | Brecher et al. | 204/129 |
| 4,007,107 | 2/1977 | Johnson | 204/293 |
| 4,059,496 | 11/1977 | Schulten et al. | 204/104 |
| 4,127,468 | 11/1978 | Alfenaar et al. | 204/293 |

FOREIGN PATENT DOCUMENTS

| | | | |
|---|---|---|---|
| 4819078 | 10/1969 | Japan | 204/290 H |
| 1195871 | 6/1970 | United Kingdom | 204/290 H |

*Primary Examiner*—R. L. Andrews
*Attorney, Agent, or Firm*—R. D. Fuerle

[57] ABSTRACT

An improved electrode is disclosed for the anode in a sulfur cycle hydrogen generation process where sulfur dioxie is oxidized to form sulfuric acid at the anode. The active compound in the electrode is palladium, palladium oxide, an alloy of palladium, or a mixture thereof. The active compound may be deposited on a porous, stable, conductive substrate.

8 Claims, 4 Drawing Figures

PROCESS FOR FORMING SULFURIC ACID

BACKGROUND OF THE INVENTION

Of all of the advanced concepts proposed for the large scale production of hydrogen, the process described in U.S. Pat. No. 3,888,750 is probably the most economical. That process is a two-step cycle. At lower temperatures (≦100° C.), sulfur dioxide is electrochemically oxidized to produce sulfuric acid on the anode while hydrogen gas is simultaneously generated on the cathode. Sulfuric acid produced in the electrolyzer is then concentrated and catalytically reduced at higher temperatures (>800° C.) into sulfur dioxide and oxygen. Subsequently, the sulfur dioxide is recycled as a reactant in the first step. The reversible voltage for the conventional electrolysis of water is as high as 1.23 V. The use of sulfur dioxide as an anode depolarizer reduces the thermodynamic voltage of an electrolyzer to only 0.17 V (at unit activity for reactants and products). Therefore, the electrolysis process, through the use of electrochemical oxidation of sulfur dioxide (in place of the anodic evolution of oxygen) utilizes theoretically only about 14% of the electric power required in the conventional water electrolysis. Since the catalytic oxidation of sulfur dioxide is highly irreversible on the platinum catalyst currently being used, the activation overpotential on the anode is normally over 0.3 V at a practical current density (say, 200 mA/cm$^2$). Consequently, one is not able to obtain a voltage efficiency above 50% in an electrolyzer even if the ohmic loss is excluded. Obviously, the anodic overpotential is always one of the major sources of the efficiency loss in the sulfur cycle hydrogen generation process. In order to improve the energy efficiency of a sulfur dioxide depolarized electrolyzer, it is of particular importance to find better electrode materials to use instead of platinum for the catalytic oxidation of sulfur dioxide in an acidic medium.

SUMMARY OF THE INVENTION

I have found that a pre-anodized palladium electrode is far superior to a platinum electrode in the anodic oxidation of sulfur dioxide. At the same potential, 1 volt, the reaction rate is 30 times greater for a pre-anodized palladium electrode than it is for a platinum electrode. While palladium has been used for hydrogen evolution in electrochemical reactions before, it is not clear why it has a so much greater reaction rate than platinum in this particular reaction. I have also found that the pre-anodized palladium electrode is stable under operating conditions. In addition, palladium monoxide (PdO) and the alloys containing palladium are highly active for the electrochemical oxidation of sulfur dioxide.

PRIOR ART

U.S. Pat. No. 3,888,750 describes a hydrogen generation system of the type in which the electrode of this invention would be used.

U.S. Pat. No. 4,059,496 also describes a process for the electrolytic production of sulfuric acid by oxidation of sulfur dioxide in the presence of water at an anode. The anode is described as graphite coated with a fine platinum film.

DESCRIPTION OF THE INVENTION

Figure 1:
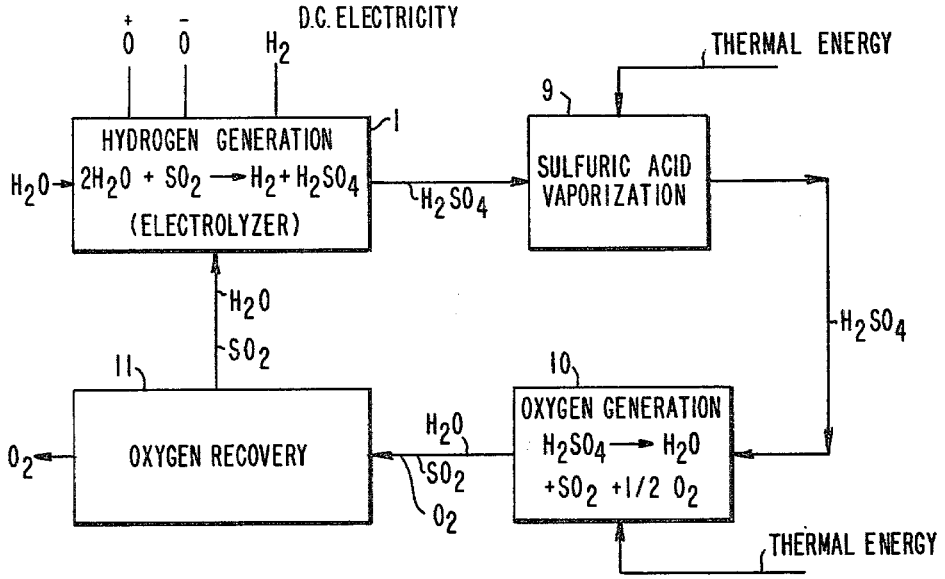
FIG. 1 is a block diagram illustrating the sulfur cycle hydrogen generation process in which the electrode of this invention is used.
Figure 2:
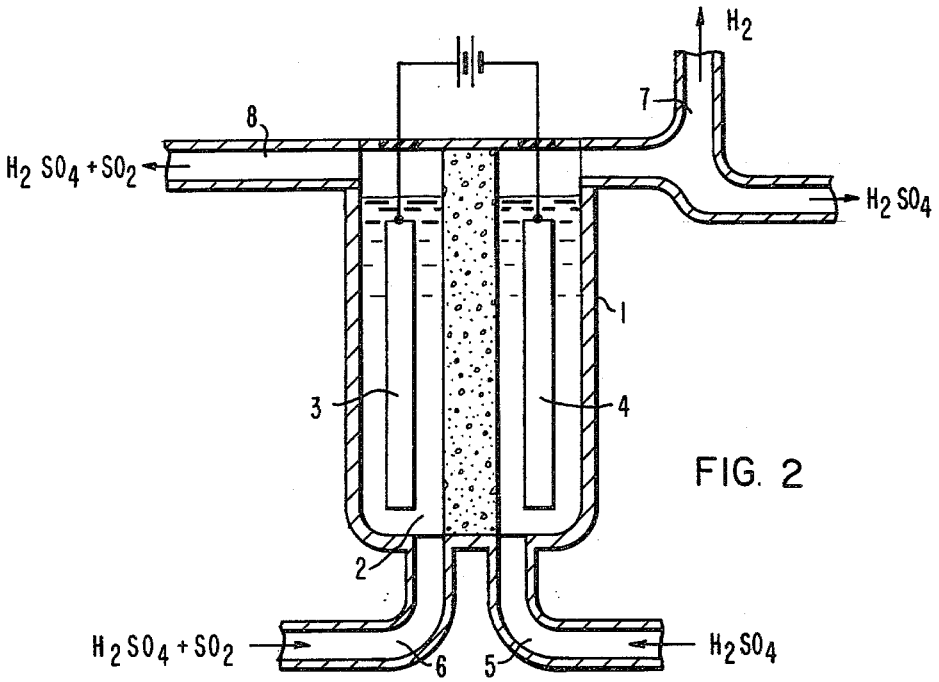
FIG. 2 is a diagram of an electrolytic cell showing a certain presently preferred embodiment of an electrode according to this invention.

In FIGS. 1 and 2, an electrolyzer (1) contains an aqueous solution of sulfuric acid (2) which is saturated with $SO_2$. Direct current is applied to the electrolyzer through an anode (3) and a cathode (4) which generates hydrogen at the cathode and sulfuric acid at the anode. Inlets (5) and (6) are provided for the additon of less concentrated sulfuric acid and additional sulfur dioxide. The hydrogen produced leaves by outlet (7) where it separates from the sulfuric acid. Sulfur dioxide which has not been consumed leaves by outlet (8) with the sulfuric acid solution, and both are recycled. A portion of the sulfuric acid from outlet (8) passes to vaporizer (9) where water is evaporated and its concentration is increased. The concentrated sulfuric acid then passes to oxygen generator (10) where the sulfuric acid is heated over a catalyst, for example, of platinum or vanadium pentoxide, to decompose it into water, sulfur dioxide, and oxygen which pass to oxygen recovery unit (11). In oxygen recovery unit (11) the sulfur dioxide is separated from the oxygen by lowering the temperature to condense it to a liquid. Sulfur dioxide and water are then returned to inlet (6) of electrolytic cell (1), thus completing the cycle.

The electrode materials of this invention are palladium and palladium monoxide (PdO). That is, either palladium oxide, a powder, can be used or palladium metal. The metal rapidly forms an oxide film on its surface when pre-anodized in aqueous solutions. The oxide is currently preferred to the metal, however, because the oxide is much stabler electrochemically than the metal. The palladium can be alloyed with other elements which are stable in sulfuric acid such as platinum, iridium, ruthenium, rhodium, rhenium, gold, titanium, tantalum, and tungsten. A mixed oxide containing palladium is also contemplated. If an alloy is used the palladium in it should be at least 10% and preferably at least 20%. Alloys and mixed oxides may present advantages such as lower cost and slightly higher reaction rates, although pure palladium monoxide is currently the preferred electrode material.

The actual electrode contemplated for commercial use consists of finely divided palladium, palladium monoxide, or a palladium alloy deposited on a porous substrate as the use of an electrode made entirely of palladium would be prohibitly expensive. Any material which is porous, stable in sulfuric acid, conductive, and durable may be used as a substrate. Currently the preferred substrate materials porous are carbon or sintered titanium. The substrate material is preferably about 1.3 to about 2.5 millimeters thick and preferably has a pore size of less than 0.1 microns. The substrate is usually used in the form of plates. A typical specific surface area of the carbon substrate is about 450 square meters per gram.

The electrode material may be deposited on the substrate by vacuum deposition, a technique well known in the art. A preferred loading of the electrode material on the substrate is about 1 to about 10 milligrams per square centimeter. Palladium and its alloys do not dissolve in the sulfuric acid because they immediately form an oxide film on the metal which protects it. However, the electrode is preferably pretreated to build up a stable oxide film which then produces a stable current in use, that is a current which does not decrease with time. Pretreatment may be accomplished by applying a potential of about 1.0 volt for about 30 minutes across the electrode immersed in the sulfuric acid solution saturated with sulfur dioxide.

The electrolyte is an aqueous solution of sulfuric acid which is saturated with sulfur dioxide. The sulfuric acid must be present as it functions as a charge carrier. The sulfuric acid concentration should be as high as possible but at a concentration of over about 60% (by weight) the sulfuric acid which is produced by the electrolytic reaction should be drawn off as otherwise the cell becomes less efficient. Overall energy efficiency of the process is low if the sulfuric acid concentration in the electrolyzer is less than 30%. The optimum temperature for use of the cell has not yet been established but it is known that at higher temperatures the solubility of sulfur dioxide in the electrolyte decreases. The cell is preferably operated at between 80 and 100° C. A detailed description of the operated of the entire sulfur cycle hydrogen generation process can be found in U.S. Pat. No. 3,888,750, herein incorporated by reference.

The following examples further illustrate this invention.

EXAMPLE 1

Figure 3:
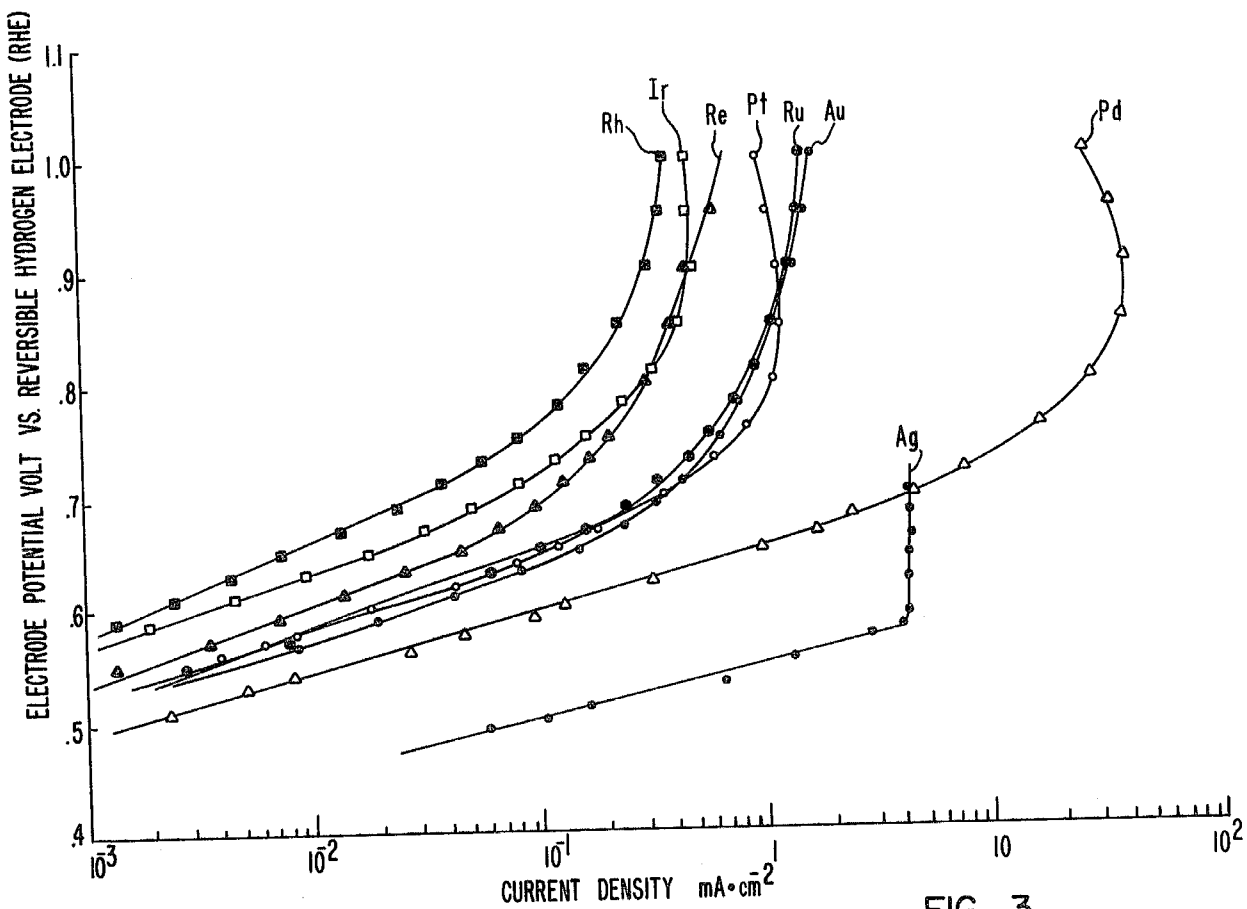
FIG. 3 is a graph giving the reaction rate of various electrode materials at different electrode potentials.

Wires of pure palladium, platinum, gold, silver, ruthenium, rhenium, iridium, and rhodium 0.25 millimeters in diameter were placed in aqueous solutions of 50% sulfuric acid saturated with sulfur dioxide gas at 25° C. A platinum screen about 1 centimeter away from the wire anode was used as the cathode. The electrodes were preanodized at 1.0 volt for 30 minutes. Using the steady state potentiostatic method, the voltage of each electrode was decreased from 1.0 volt to 0.5 volt while the current was measured. FIG. 3 shows the results of this experiment and indicates that at 1.0 volt the reaction rate for sulfur dioxide oxidation on palladium is about 30 times superior to that of platinum, the next best metal.

EXAMPLE 2

Figure 4:
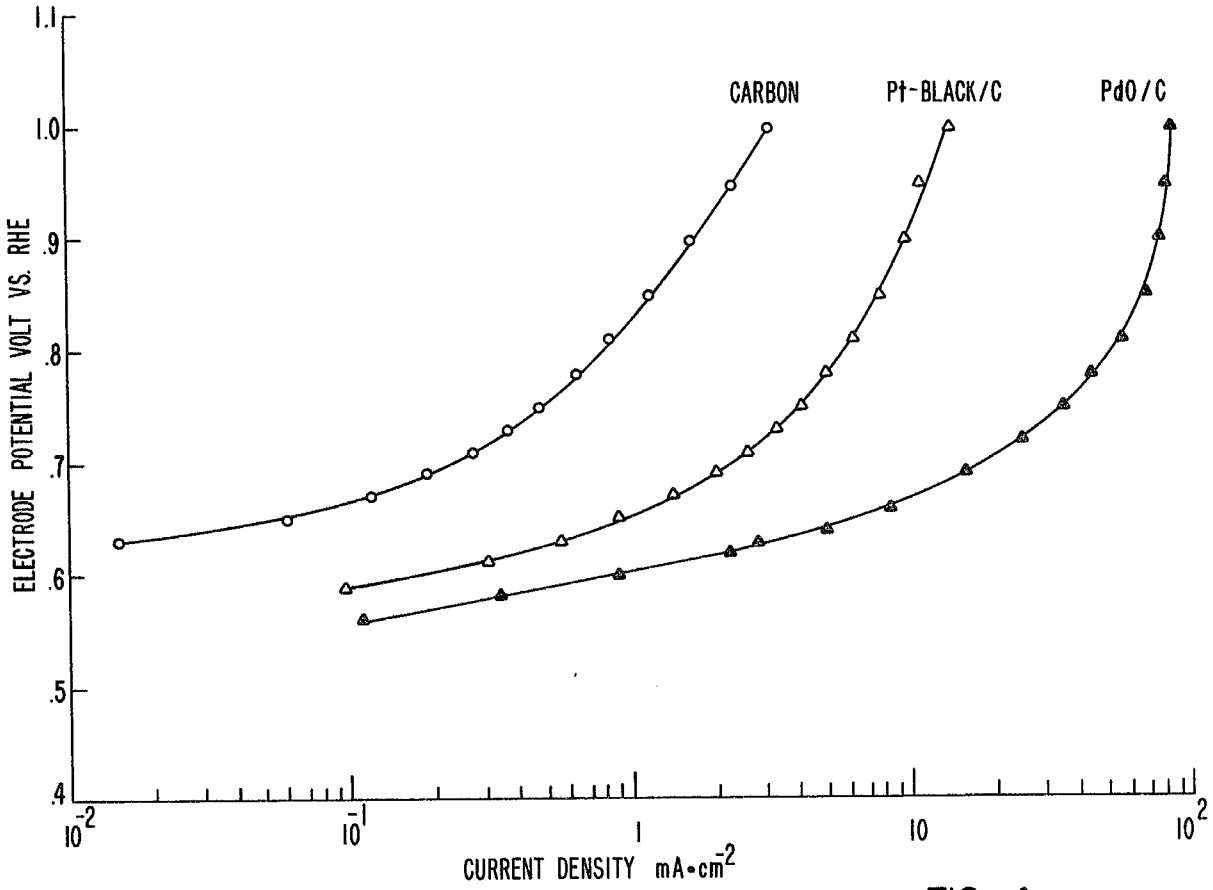
FIG. 4 is a graph giving the reaction rate of the palladium monoxide (PdO) electrodes at various electrode potentials, as compared to platinum black and pure carbon electrodes.

Electrodes were prepared by deposition of platinum or palladium monoxide on porous carbon substrates about 5 to 5 centimeters by 0.2 centimeters thick having a pore size of 9 micrometers. The loading was 10 milligrams per centimeter squared. The electrodes were pretreated by applying a potential of about 1 volt for about 30 minutes across them as they were immersed in the 50% sulfuric acid solutions saturated with sulfur dioxide. The electrodes were tested in the same manner as in Example 1. FIG. 4 gives the results of this experiment. The results indicate that palladium monoxide (PdO) is far superior to the platinum black.

What is claim is:

1. In a method for anodically oxidizing sulfur dioxide to sulfuric acid in an aqueous solution which is saturated with sulfur dioxide and comprises at least about 50% sulfuric acid, the improvement which comprises using an anode which is stable in said aqueous solution and which has a surface comprising palladium.

2. An improved method according to claim 1 wherein at least about 10 atomic % of said electrode material is the element palladium and the remainder is selected from the group consisting of oxygen and elements which are stable in sulfuric acid, said oxygen and elements being present as metals, oxides, alloys, or oxides of alloys.

3. An improved method according to claim 2 wherein said elements include platinum, iridium, ruthenium, rhodium, rhenium, gold, titanium, tantalum, tungsten, or mixtures thereof.

4. An improved method according to claim 1 wherein said electrode material is deposited on a porous, stable, conductive substrate.

5. An improved method according to claim 4 wherein said substrate is porous carbon.

6. An improved method according to claim 5 wherein said substrate is carbon having a pore size of less than 0.1 microns.

7. An improved method according to claim 4 wherein the loading of said electrode material on said substrate is about 1 to about 10 milligrams per square centimeter.

8. An improved method according to claim 1 wherein said electrode material is palladium monoxide.

* * * * *